US012006723B2

(12) United States Patent
Huang

(10) Patent No.: US 12,006,723 B2
(45) Date of Patent: Jun. 11, 2024

(54) PORTABLE ABOVE-GROUND POOL

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 69 days.

(21) Appl. No.: 17/826,749

(22) Filed: May 27, 2022

(65) Prior Publication Data

US 2023/0037454 A1 Feb. 9, 2023

(30) Foreign Application Priority Data

Aug. 3, 2021 (CN) ..... 202121793495.X

(51) Int. Cl.
*E04H 4/00* (2006.01)
*E04H 4/14* (2006.01)

(52) U.S. Cl.
CPC ..... *E04H 4/0025* (2013.01); *E04H 4/14* (2013.01)

(58) Field of Classification Search
CPC ..... E04H 4/0025; E04H 4/14
USPC ..... 4/506–509, 488, 513
See application file for complete search history.

(56) References Cited

U.S. PATENT DOCUMENTS 4,756,032 A * 7/1988 Wang ..... E04H 4/0025 4/588
9,574,362 B2 * 2/2017 Zhu ..... E04H 4/14
11,788,310 B2 * 10/2023 Tai ..... E04H 4/0025 4/513
2015/0167336 A1 * 6/2015 Leung ..... E04H 4/14 156/253
2019/0161986 A1 * 5/2019 Huang ..... E04H 4/0025
2021/0148130 A1 * 5/2021 Leung ..... E04H 4/14

FOREIGN PATENT DOCUMENTS

CN 206477626 U * 9/2017 ..... A63B 63/00
CN 209211974 8/2019
CN 209211974 U * 8/2019
(Continued)

OTHER PUBLICATIONS

Extended European Search Report dated Dec. 15, 2022 (dated Dec. 15, 2022) issued on related European patent application 22179395.3 by the European Patent Office.

*Primary Examiner* — Lori L Baker
(74) *Attorney, Agent, or Firm* — DICKINSON WRIGHT PLLC

(57) ABSTRACT

An above-ground pool includes a pool bottom and a pool wall, together defining a water storage space. The pool bottom includes a lower bottom sheet connected to the pool wall and an upper bottom sheet, the upper and lower bottom sheets connected in a ring region and defining a sandwich region. A porous elastic material is disposed between the upper bottom sheet and the lower bottom sheet in the sandwich region. A water drainage device includes a water drainage valve and a water drainage pipe, and the water drainage valve penetrates through the pool bottom and connects to the water drainage pipe beneath the pool bottom. A vent hole through the lower bottom sheet, and located in a region where the pool bottom is lifted by the water drainage pipe, provides communication between the porous elastic material and an exterior of the pool.

15 Claims, 4 Drawing Sheets

(56) References Cited

FOREIGN PATENT DOCUMENTS

| | | | | | |
|---|---|---|---|---|---|
| CN | 210798400 | U | * | 6/2020 | ..... E04H 4/0025 |
| CN | 111764707 | | | 10/2020 | |
| CN | 111764707 | A | * | 10/2020 | |
| CN | 212535234 | U | * | 2/2021 | ..... E03C 1/20 |
| CN | 217724070 | U | * | 11/2022 | ..... A61H 33/0087 |
| EP | 3913167 | A2 | * | 11/2021 | ..... E03C 1/20 |
| EP | 4119119 | A1 | * | 1/2023 | ..... A61H 33/00 |
| WO | WO-2015085227 | A1 | * | 6/2015 | ..... A47K 3/06 |
| WO | WO-2019148381 | A1 | * | 8/2019 | ..... A61H 33/02 |

* cited by examiner

PORTABLE ABOVE-GROUND POOL

CROSS-REFERENCE TO RELATED APPLICATION

This application claims priority from Chinese Application CN 202121793495.X, filed Aug. 3, 2021 in China, the disclosure of which is incorporated herein by reference in its entirety.

BACKGROUND

1. Field

Apparatuses and methods consistent with exemplary embodiments relate to a portable above-ground pool.

2. Description of the Related Art

A portable above-ground pool is typically placed directly on the ground. To improve the comfort of stepping in the pool, a sandwich structure, including materials such as sponge or pearl cotton (i.e., Expanded Polyethylene (EPE)) therein, is often arranged at the bottom of the pool.

At times, gas bulge may be formed within the sandwich structure, either due to air being taken in during the manufacturing process of the sandwich structure, or by air, previously present in the porous materials, being squeezed out after a period of use. Due to the sealing requirements of the sandwich structure, such a gas bulge is not only difficult to eliminate, but may continuously increase, thereby affecting use of the above-ground pool and causing complaints from customers.

To eliminate the gas bulge, a vent hole may be formed beneath the pool bottom. However, external water, adjacent to the pool may enter the sandwich structure through the vent hole abutting the ground, making the above-ground pool inconvenient to store. In addition, such water entering the sandwich structure may cause mildew, rot, and aging of the materials such as sponge or pearl cotton, thereby shortening the service life of the above-ground pool.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, a pool is provided comprising a pool bottom and a pool wall, together defining a water storage space; and a water drainage device comprising a valve, penetrating the pool bottom, and a pipe connected to the valve beneath the pool bottom; wherein the pool bottom comprises an enclosed sandwich region and a porous elastic material disposed in the sandwich region, and a vent hole providing communication between an environment external to the pool and the porous elastic material; wherein the vent hole is disposed in a region of the pool bottom deformed by the water drainage pipe.

The water drainage valve may penetrate through the enclosed sandwich region and be disposed closer to an edge of the sandwich region than to a center thereof.

The enclosed sandwich region may comprise a main sandwich region and an exhaust region in gas communication with the main sandwich region through at least one exhaust channel, and the vent hole and the water drainage valve may be disposed in the exhaust region.

The sandwich region may comprise: an upper bottom sheet and a lower bottom sheet connected to the upper bottom sheet, wherein a discontinuity in a connection between the upper bottom sheet and the lower bottom sheet defines an exhaust channel.

The vent hole may be disposed at a first side of the water drainage valve, and the exhaust channel may be disposed at a second side of the water drainage valve, opposite the first side.

The pool bottom further may comprise a wave-making channel comprising a plurality of apertures providing communication between the wave-making channel and the water storage space.

The pool bottom may further comprise an upper bottom sheet, a lower bottom sheet, and an annular confining strip; wherein, an outer periphery of the lower bottom sheet is connected to the pool wall, an outer periphery of the upper bottom sheet is connected to an inner periphery of the annular confining strip; an outer periphery of the annular confining strip is connected to the lower bottom sheet; and the upper bottom sheet and the lower bottom sheet are connected together in a ring region inward from the pool wall, such that a wave-making channel is defined in a space between the annular confining strip, a portion of the lower bottom sheet outside the ring region and a portion of the upper bottom sheet outside the ring region; and wherein the enclosed sandwich region is defined within the ring region.

The pool wall may comprise at least one of a frame and an inflatable air chamber.

The pool wall may comprise an inner side wall and an outer side wall, wherein an inflatable air chamber is defined between the inner side wall and the outer side wall, and a tensioning structure is disposed between the inner side wall and the outer side wall.

The tensioning structure may comprise an X-shaped tensioning member.

According to an aspect of another example embodiment, a pool is provided comprising: a pool bottom and a pool wall, together defining a water storage space, the pool bottom comprising: a lower bottom sheet having an outer periphery connected to the pool wall, an upper bottom sheet connected, in a ring region, to the lower bottom sheet, such that a sandwich region is defined within the ring region, between the lower bottom sheet and the upper bottom sheet, and a porous elastic material disposed in the sandwich region between the lower bottom sheet and the upper bottom sheet, and at least one vent hole penetrating the lower bottom sheet in the sandwich region, thereby providing communication between the porous elastic material and an environment external to the pool; and a water drainage device comprising a drainage pipe disposed below the lower bottom sheet, and a valve drainage providing communication between the water storage space and the drainage pipe, wherein the drainage pipe is disposed such that, when resting on a surface, the drainage pipe holds a lifted region of the lower bottom sheet off the surface; wherein the vent hole penetrates the lower bottom sheet in the lifted region.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
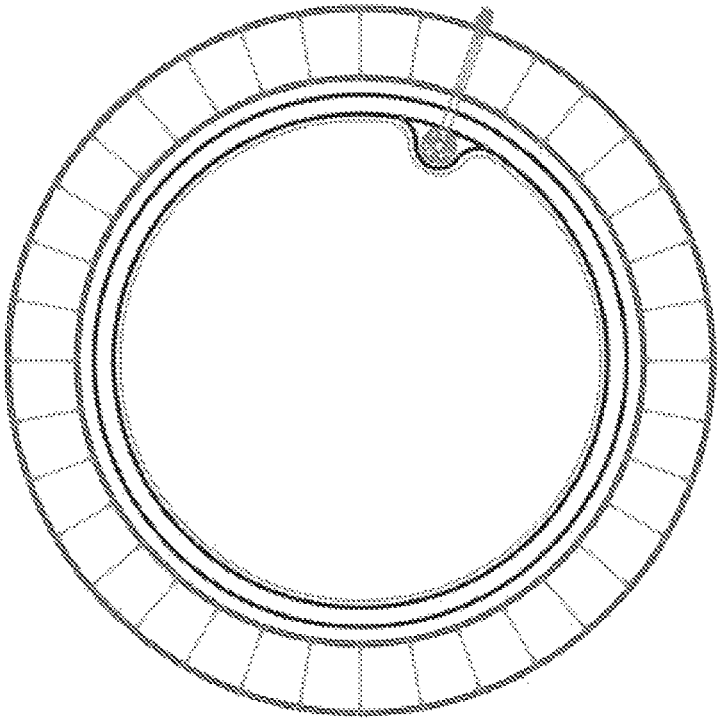
FIG. 1 is a schematic top view of a portable above-ground pool without a vent hole according to an example embodiment.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these exemplary embodiments pertain may not be described here in detail.

It should be understood that in this description, expressions of orientation such as, but not limited to, "upper," "lower," "inner," "outer," "top," and "bottom,", which are used for explaining structural positions of various components, are not absolute but relative. These orientation expressions are appropriate when the various components are arranged as shown in the figures, but should change accordingly when the positions of the various components in the figures change.

Figure 2:
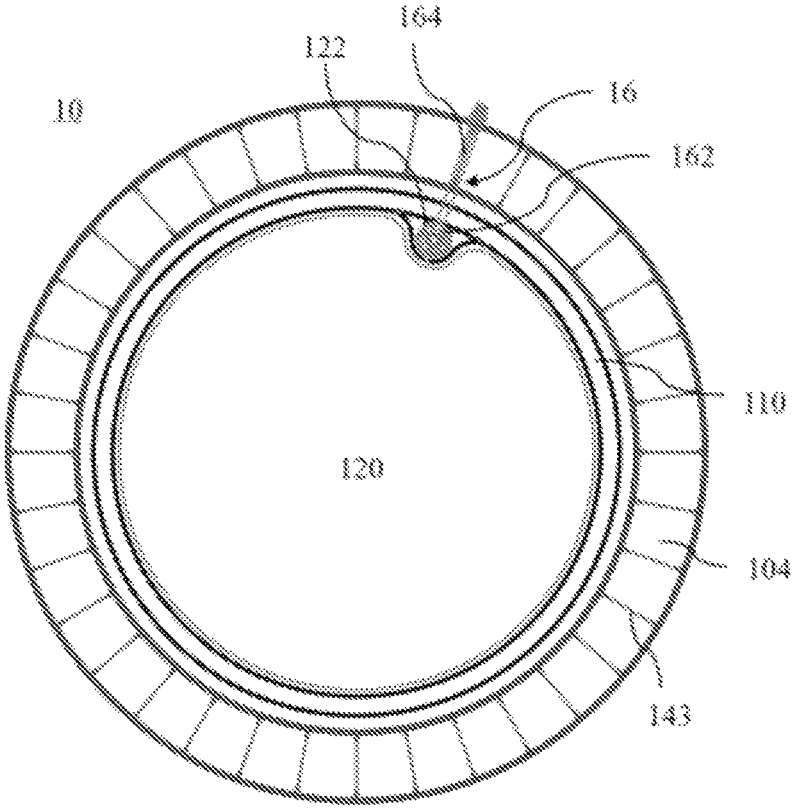
FIG. 2 is a schematic top view of a portable above-ground pool with a vent hole, according to an example embodiment.
Figure 6:
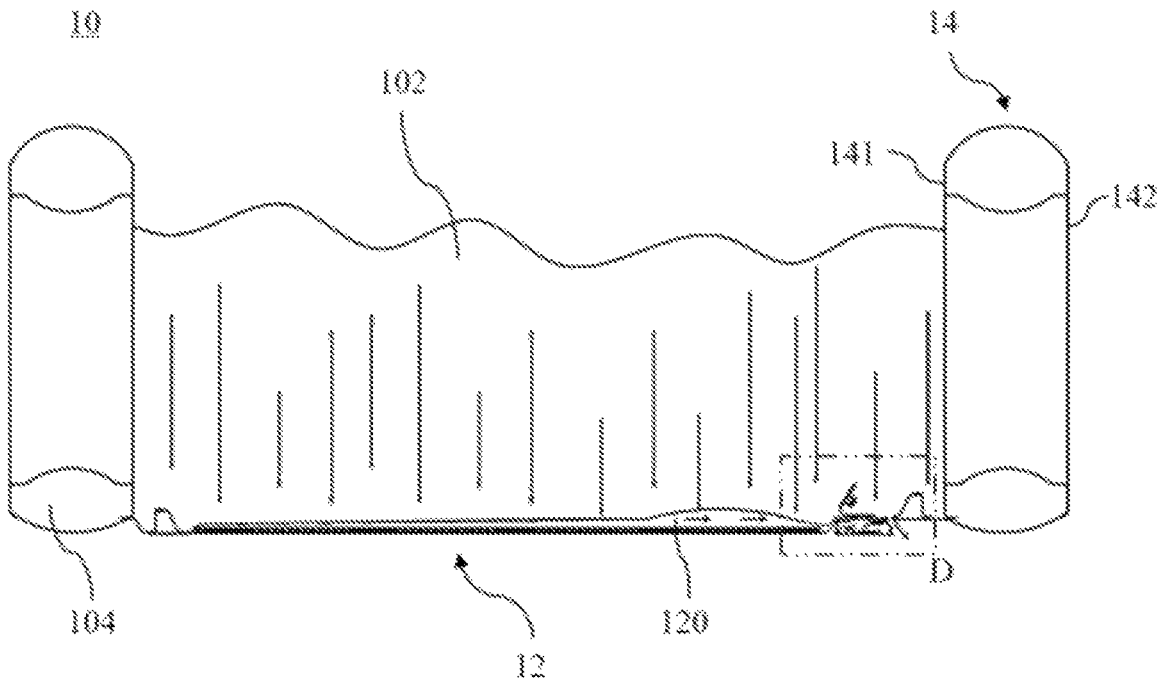
FIG. 6 is a side sectional view of the portable above-ground pool as shown in FIG. 2.
Figure 7:
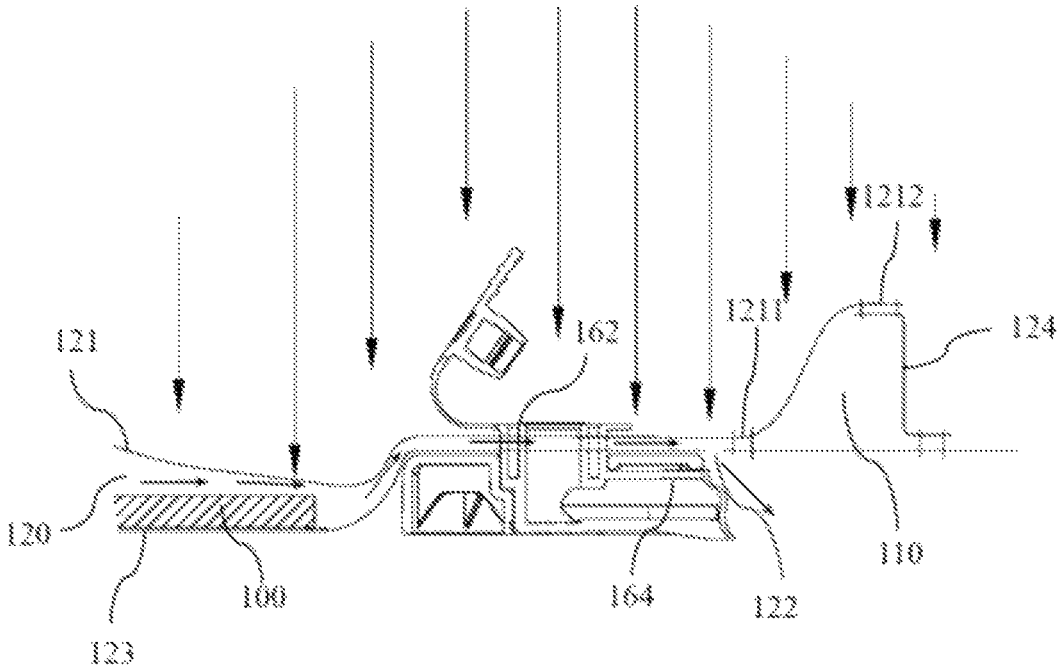
FIG. 7 is an enlarged schematic diagram of a portion D in FIG. 6.

FIG. 1 shows a state of a portable above-ground pool without a vent hole, and FIG. 2 shows a state of a portable above-ground pool with a vent hole formed therein. FIG. 2 shows a top view of a portable above-ground pool 10, according to an example embodiment. As shown in FIG. 6 and FIG. 7, the portable above-ground pool 10 comprises a pool bottom 12 and a pool wall 14, the pool bottom 12 and the pool wall 14 defining a water storage space 102. As shown in FIG. 2, the pool bottom 12 is provided with a water drainage device 16 and an enclosed sandwich region 120. Porous elastic material 100 is disposed in the sandwich region 120, and the porous elastic material 100 may be one or more of various materials including pearl cotton (EPE) and sponge, so as to provide a comfortable feeling for users to step on the pool bottom and also to provide thermal insulation. The water drainage device 16 comprises a water drainage valve 162 and a water drainage pipe 164. The water drainage valve 162 penetrates through the pool bottom 12 and is connected to the water drainage pipe 164 beneath the pool bottom.

Figure 3:
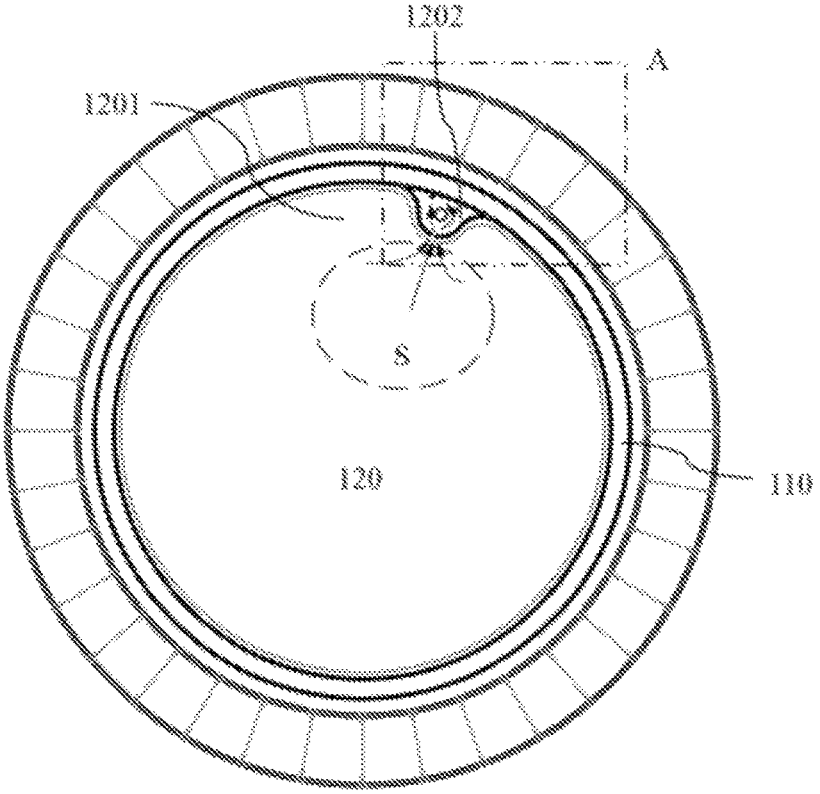
FIG. 3 is a schematic diagram showing an exhaust path of the portable above-ground pool as shown in FIG. 2.

Refer to FIG. 3, an area S represents a potential gas bulge which is formed in the sandwich region 120. To discharge gas from the gas bulge, as shown in FIG. 2, the sandwich region 120 is provided with at least one vent hole 122 in gas communication with an environment outside the pool. It is noted that FIG. 2 shows an exemplary position of the vent hole. The vent hole 122 provides an exhaust path for allowing the inside of the sandwich region 120 to be in gas communication with the environment outside the pool. The gas bulge may reach the vent hole 122 to be eliminated due to the water pressure indicated by an arrow in FIG. 7 or by a user stepping thereon. According to one or more example embodiments, and as shown in FIG. 2 and FIG. 7, at least one vent hole 122 is adjacent to the water drainage valve 162. The water drainage valve 162 penetrates through the pool bottom 12 and is connected to the water drainage pipe 164, and the area of the pool bottom 12 that is adjacent to the water drainage valve 162 is lifted by the water drainage valve 162, such that the vent hole 122 adjacent to the water drainage valve 162 is lifted from a surface, such as the ground, on which the above-ground pool is disposed. In such a manner, the vent hole 122 is not blocked and water is prevented from entering the sandwich region 120 through the vent hole 122.

FIG. 2 shows the sandwich region 120 arranged at the pool bottom 12 and also shows a wave-making channel 110, according to an example embodiment. The wave-making channel 110 is arranged at the pool bottom 12 and is provided with a plurality of wave-making apertures (not shown). Pressurized gas is fed into the wave-making channel, and bubbles or jet gas flows are projected into the pool though the wave-making apertures. As shown in FIG. 6 and FIG. 7, the sandwich region 120 is formed by connecting a first bottom sheet 121 and a second bottom sheet 123 positioned below the first bottom sheet 121. The second bottom sheet 123 is connected to the pool wall 14 to form the water storage space 102, an inner ring edge 1211 of the first bottom sheet 121 is connected to the second bottom sheet 123 to define the sandwich region 120, and the wave-making channel 110 is defined by a confining strip 124 which is connected to an outer ring edge 1212 of the first bottom sheet 121 and the second bottom sheet 123, respectively. As shown in the FIG. 7, an upper edge of the confining strip 124 is connected to the outer ring edge 1212 of the first bottom sheet 121, and a lower edge of the confining strip 124 is connected to the second bottom sheet 123. The first bottom sheet 121 is connected to the second bottom sheet 123, and accordingly, the sandwich region 120 and the wave-making channel 110 are formed. It should be noted that the vent hole 122 may be formed in the second bottom sheet 123, and may be formed in an area of the second bottom sheet 123 that defines the sandwich region 120.

According to one or more example embodiments, the water drainage valve 162 penetrates through the sandwich region 120, which may be favorable under a condition that the pool bottom 12 is provided with the sandwich region 120 which has a greater area ratio. Alternately, the water drainage valve 162 penetrates through the pool bottom 12 instead of the sandwich region. At least one vent hole in the sandwich region is adjacent to an edge of the sandwich region, and the water drainage valve may also be adjacent to an edge of the sandwich region. The at least one vent hole may be positioned inside the sandwich region, and the water drainage valve may be positioned outside the sandwich region, such that the at least one vent hole is lifted off the ground by the water drainage valve. In such a manner, the gas bulge may be quickly eliminated.

According to an example embodiment, as shown in FIG. 2, the wave-making channel 110 is in the form of a ring and is arranged at an outer periphery of the sandwich region 120. The water drainage valve 162 penetrates through the sandwich region 120 and the water drainage valve 162 is arranged at the edge of the sandwich region 120, which may be favorable under a condition that the first bottom sheet 121 is connected to the second bottom sheet 123 to form the sandwich region 120 and the wave-making channel 110. As a result, a comfortable feeling within a sufficient area when a user steps on the pool bottom can be provided, and wave-making bubbles or jet gas flows with a massage effect can also be generated.

Figure 4:
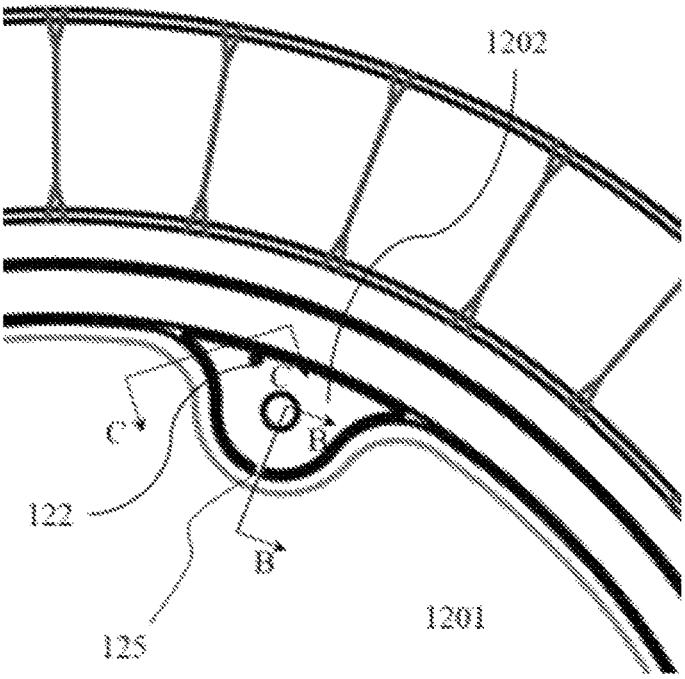
FIG. 4 is an enlarged schematic diagram of a portion A in FIG. 3.

The vent hole 122 may be formed at the edge of the sandwich region 120 in an example embodiment in which the water drainage valve 162 penetrates through the sandwich region 120 or in an example embodiment in which the water drainage valve 162 penetrates through the pool bottom 12 instead of through the sandwich region 120. As shown in FIG. 4, the sandwich region 120 is divided into a main sandwich region 1201 and an exhaust region 1202, wherein the exhaust region 1202 is positioned at the edge of the sandwich region 120 and is provided with at least one vent hole 122, and the main sandwich region 1201 is in gas communication with the exhaust region 1202 through at least one exhaust channel 125 to separate the porous elastic material in the main sandwich region 1201 from atmospheric environment outside the vent hole 122 by a certain distance, thereby further providing that the porous elastic material in the main sandwich region 1201 is not affected by an external environment. According to an example embodiment as shown in FIG. 4, and with reference to FIG. 2, the water drainage valve 162 penetrates through the exhaust region 1202, such that the vent hole 122 is adjacent to the water drainage valve 162 and to provide for the wave-making channel 110. According to one or more example embodiments, the water drainage valve 162 may be arranged in the sandwich region 120 due to the existence of the wave-making channel 110.

Figure 5A:
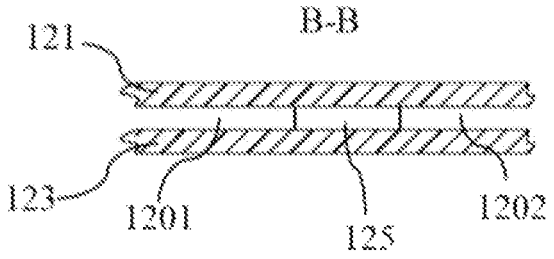
FIG. 5*a* is a sectional schematic diagram at section B-B in FIG. 4.
Figure 5B:
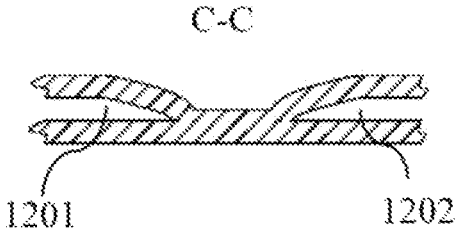
FIG. 5*b* is a sectional schematic diagram at section C-C in FIG. 4.

As shown in FIG. 5*a* and FIG. 5*b*, the first bottom sheet 121 and the second bottom sheet 123 below the first bottom sheet 121 together form the sandwich region 120. The first bottom sheet 121 and the second bottom sheet 123 are shown according to by an example in which the main sandwich region 1201 is in gas communication with the exhaust region 1202 through an exhaust channel 125. The first bottom sheet 121 and the second bottom sheet 123 are separated at the exhaust channel 125, as shown in a sectional view of the section B-B, and are connected to one another beyond the exhaust channel 125, as shown in a sectional view of the section C-C. Accordingly, as shown, the first bottom sheet 121 and the second bottom sheet 123 are discontinuously connected in the sandwich region 120, so that at least one exhaust channel 125 is formed in a position where the connection is interrupted. The number of vent holes 122 in the exhaust region 1202 is not limited by the illustrated example embodiments.

At least one vent hole 122 and at least one exhaust channel 125 may be positioned on opposite sides of the water drainage valve 162, so that the vent hole 122 is spaced from the exhaust channel 125 by a certain distance, and the porous elastic material 100 in the main sandwich region 1201 is thus further encouraged to dry.

In conjunction with FIG. 6 and FIG. 7, in the exhaust path of the gas bulge as shown in FIG. 3, the example gas bulge in the main sandwich region 1201 is gradually gathered to the exhaust channel 125 under water pressure or by being pressed manually, and gas in the gas bulge enters the exhaust region 1202 through the exhaust channel 125 and is finally discharged through the vent hole 122 in the exhaust region 1202. In FIG. 7, the pool bottom 12 is lifted at a position adjacent to the vent hole 122 by the water drainage valve 162 and the water drainage pipe 164, such that gas in the exhaust region 1202 can be smoothly discharged. After gas is discharged under water pressure, materials near the vent hole are compressed through the pressure of the water in the pool (for example, the first bottom sheet 121 of the exhaust region in which the vent hole is formed is compressed to the second bottom sheet 123 below) to enclose the exhaust path, so that water/gas outside the pool can be prevented from entering the sandwich region. In addition, the exhaust region 1202 serves as a buffer region for separating the external environment outside the pool from the main sandwich region 1201.

According to one or more example embodiments, the pool 10 includes a pool wall 14 with an inflatable air chamber 104. As shown in FIG. 6, the pool wall 14 may comprise an inner side wall 141 and an outer side wall 142, the inner side wall 141 and the outer side wall 142 defining the inflatable air chamber 104. A tensioning structure 143 (as shown in FIG. 2) is arranged between the inner side wall 141 and the outer side wall 142 to restrain the shape of the inflatable air chamber 104. Based on the perspective of FIG. 2, the tensioning structure 143 may include, but is not limited to: a straight tensioning member, an X-shaped tensioning member, and a Y-shaped tensioning member.

A straight tensioning member may include two ends which are respectively and directly connected to the inner side wall 141 and the outer side wall 142.

With reference to FIG. 2 and FIG. 4, an X-shaped tensioning member may include a main tensioning part and branch parts which are arranged at two ends of the main tensioning part, wherein the branch parts are separated from positions where same are connected to the main tensioning part to form branches, and each branch is respectively connected to the inner side wall 141 or the outer side wall 142 to disperse tensile force of the tensioning structure 143 on the inner side wall 141 and the outer side wall 142, and reduce the risk of material stripping caused by excessive local tensile force.

A Y-shaped tensioning member may include a main tensioning part and branch parts, wherein one end of the main tensioning part is directly connected to one of the inner side wall 141 and the outer side wall 142, the branch parts are arranged at the other end of the main tensioning part and are separated from positions where the branch parts are connected to the main tensioning part to form branches, and each branch is respectively connected to the other one of the inner side wall 141 and the outer side wall 142 to disperse tensile force of the tensioning structure 143 on the corresponding side wall and reduce the risk of material stripping caused by excessive local tensile force.

According to one or more example embodiments, the pool wall 14 is supported by a frame, and the pool wall 14 is integrally formed with the second bottom sheet 123, the bottom sheet 123 being positioned below as part of the sandwich region 120. In this case, the first bottom sheet 121 may have an area smaller than that of the second bottom sheet 123, and may be connected to the second bottom sheet 123 from above the second bottom sheet 123 to form the enclosed sandwich region 120.

According to one or more example embodiments, the sandwich region may be is comfortable to step on, and a gas bulge in the sandwich region may be easily eliminated, ensuring the pool to be still comfortable to step on after a long time of use. Arrangements of one or more of the example embodiments may provide a vent hole which is not blocked and which will not be flooded with water, so that the service life of the porous elastic material in the sandwich region may be prolonged.

It may be understood that the exemplary embodiments described herein may be considered in a descriptive sense only and not for purposes of limitation. Descriptions of features or aspects within each exemplary embodiment may be considered as available for other similar features or aspects in other exemplary embodiments.

While exemplary embodiments have been described with reference to the figures, it will be understood by those of ordinary skill in the art that various changes in form and details may be made therein without departing from the spirit and scope as defined by the following claims.

What is claimed is:

1. A pool, comprising:

a pool bottom and a pool wall, together defining a water storage space; and a water drainage device comprising a valve, penetrating the pool bottom, and a pipe connected to the valve beneath the pool bottom;

wherein the pool bottom comprises an enclosed sandwich region and a porous elastic material disposed in the sandwich region, and a vent hole providing communication between an environment external to the pool and the porous elastic material;

wherein the vent hole is disposed in a region of the pool bottom deformed by the valve of the water drainage device.

2. The pool according to claim 1, wherein the water drainage valve penetrates through the enclosed sandwich region and is disposed closer to an edge of the sandwich region than to a center thereof.

3. The pool according to claim 1, wherein the enclosed sandwich region comprises a main sandwich region and an exhaust region in gas communication with the main sandwich region through at least one exhaust channel, and wherein the vent hole and the water drainage valve are disposed in the exhaust region.

4. The pool according to claim 3, wherein the sandwich region comprises:

an upper bottom sheet and a lower bottom sheet connected to the upper bottom sheet, wherein a discontinuity in a connection between the upper bottom sheet and the lower bottom sheet defines an exhaust channel.

5. The pool according to claim 3, wherein the vent hole is disposed at a first side of the water drainage valve, and the exhaust channel is disposed at a second side of the water drainage valve, opposite the first side.

6. The pool according to claim 1, wherein the pool bottom further comprises a wave-making channel comprising a plurality of apertures providing communication between the wave-making channel and the water storage space.

7. The pool according to claim 1, wherein the pool bottom further comprises an upper bottom sheet, a lower bottom sheet, and an annular confining strip;

wherein, an outer periphery of the lower bottom sheet is connected to the pool wall, an outer periphery of the upper bottom sheet is connected to an inner periphery of the annular confining strip; an outer periphery of the annular confining strip is connected to the lower bottom sheet; and the upper bottom sheet and the lower bottom sheet are connected together in a ring region inward from the pool wall, such that a wave-making channel is defined in a space between the annular confining strip, a portion of the lower bottom sheet outside the ring region and a portion of the upper bottom sheet outside the ring region; and wherein the enclosed sandwich region is defined within the ring region.

8. The pool according to claim 7, wherein the pool wall comprises at least one of a frame and an inflatable air chamber.

9. The pool according to claim 7, wherein the pool wall comprises an inner side wall and an outer side wall, wherein an inflatable air chamber is defined between the inner side wall and the outer side wall, and a tensioning structure is disposed between the inner side wall and the outer side wall.

10. The pool according to claim 9, wherein the tensioning structure comprises an X-shaped tensioning member.

11. A pool comprising:

a pool bottom and a pool wall, together defining a water storage space, the pool bottom comprising:

a lower bottom sheet having an outer periphery connected to the pool wall, an upper bottom sheet connected, in a ring region, to the lower bottom sheet, such that a sandwich region is defined within the ring region, between the lower bottom sheet and the upper bottom sheet, and a porous elastic material disposed in the sandwich region between the lower bottom sheet and the upper bottom sheet, and at least one vent hole penetrating the lower bottom sheet in the sandwich region, thereby providing communication between the porous elastic material and an environment external to the pool; and a water drainage device comprising a drainage pipe disposed below the lower bottom sheet, and a valve drainage providing communication between the water storage space and the drainage pipe, wherein the drainage pipe is disposed such that, when resting on a surface, the drainage pipe holds a lifted region of the lower bottom sheet off the surface;

wherein the vent hole penetrates the lower bottom sheet in the lifted region.

12. The pool according to claim 11, wherein the pool bottom further comprises a wave-making channel, defined outside the ring region, comprising a plurality of apertures providing communication between the wave-making channel and the water storage space.

13. The pool according to claim 11, wherein the pool bottom further comprises:

an annular confining strip disposed outside the ring region;

wherein an outer periphery of the upper bottom sheet is connected to an inner periphery of the annular confining strip, and an outer periphery of the annular confining strip is connected to the lower bottom sheet outside, such that a wave-making channel is defined in a space between the annular confining strip, a portion of the lower bottom sheet and a portion of the upper bottom sheet.

14. The pool according to claim 11, wherein the sandwich region comprises a main sandwich region and an exhaust region, wherein an exhaust channel provides communication between a main area in the main sandwich region between the upper bottom sheet and the lower bottom sheet and an exhaust area in the exhaust region between the upper bottom sheet and the lower bottom sheet; and wherein the vent hole and the drainage valve are disposed in the exhaust region.

15. The pool according to claim 14, wherein the vent hole is disposed on a first side of the drainage valve and the exhaust channel is disposed on a second side of the drainage valve, opposite the first side.

* * * * *